US010863592B2

(12) United States Patent
Kim et al.

(10) Patent No.: US 10,863,592 B2
(45) Date of Patent: Dec. 8, 2020

(54) COOKING DEVICE AND VENTILATION APPARATUS

(71) Applicant: LG ELECTRONICS INC., Seoul (KR)

(72) Inventors: Wontae Kim, Seoul (KR); Wansoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 458 days.

(21) Appl. No.: 14/948,555

(22) Filed: Nov. 23, 2015

(65) Prior Publication Data

US 2016/0150601 A1 May 26, 2016

(30) Foreign Application Priority Data

Nov. 21, 2014 (KR) ..... 10-2014-0163255

(51) Int. Cl.

| | |
|---|---|
| ***H05B 6/64*** | (2006.01) |
| ***F24C 15/20*** | (2006.01) |
| ***F24C 15/32*** | (2006.01) |

(52) U.S. Cl.

CPC ..... *H05B 6/642* (2013.01); *F24C 15/2042* (2013.01); *F24C 15/322* (2013.01); *H05B 6/6423* (2013.01)

(58) Field of Classification Search

CPC ... H05B 6/642; H05B 6/6423; F24C 15/2042; F24C 15/322; F04D 17/16; F04D 25/08;

(Continued)

(56) References Cited

U.S. PATENT DOCUMENTS 2,772,749 A * 12/1956 Nerad ..... B01D 45/14 55/400
3,408,796 A * 11/1968 Murray ..... B01D 45/14 55/403

(Continued)

FOREIGN PATENT DOCUMENTS

DE 1679545 3/1971
JP 2001304642 10/2001

(Continued)

OTHER PUBLICATIONS

Cho, Heung-Won, WO2012102462A2, Local Exhaust Device and Irish Kitchen System Having Same, Aug. 2, 2012, Espacenet translation, Abstract only.*

(Continued)

*Primary Examiner* — Tu B Hoang
*Assistant Examiner* — Masahiko Muranami
(74) *Attorney, Agent, or Firm* — Fish & Richardson P.C.

(57) ABSTRACT

A cooking device is described. The cooking device includes a main body. The cooking device includes a ventilation apparatus that is located at a lower side of the main body, that is configured to suck air into the main body, and that is configured to discharge air from the main body. The ventilation apparatus includes a base that is connected to the lower side of the main body and that includes an introduction port. The ventilation apparatus includes a swirler that is configured to generate suction by rotating air around the introduction port of the base and that includes a plurality of wings. The ventilation apparatus includes a driving unit that is configured to rotate the swirler. The ventilation apparatus includes a swirler guide that is configured to cover an underside of the swirler and that is configured to guide a flow of air around a center of the swirler.

9 Claims, 5 Drawing Sheets

(58) Field of Classification Search
CPC .... F04D 29/522; F04D 29/441; F04D 29/624; F04D 29/644; F04D 29/701; A21B 3/139
USPC ..... 219/757, 400, 735, 393, 452.11, 452.12, 219/756, 681; 126/198, 21 A, 21 R, 126/299 R; 454/228, 230, 232, 233, 234
See application file for complete search history.

(56) References Cited

U.S. PATENT DOCUMENTS 3,802,162 A * 4/1974 Deane ..... B01D 45/14 261/90
4,327,274 A 4/1982 White et al.
4,484,063 A * 11/1984 Whittenburg ..... F24C 15/325 126/21 A
4,966,524 A * 10/1990 Kodama ..... F04D 29/547 165/126
5,458,050 A * 10/1995 Su ..... A23B 7/0205 219/386
2002/0023637 A1 2/2002 Okamoto et al.
2007/0015449 A1* 1/2007 Livchak ..... B08B 15/02 454/61
2008/0156793 A1 7/2008 Song et al.
2009/0134140 A1* 5/2009 Van Der Weij ..... A47J 37/0641 219/400
2009/0181138 A1* 7/2009 Howard ..... A23L 5/15 426/233
2013/0052049 A1* 2/2013 Fujimoto ..... F04D 17/16 417/321

FOREIGN PATENT DOCUMENTS

KR 20040008853 1/2004
WO WO 2012102462 A2 * 8/2012 ..... F24C 15/20

OTHER PUBLICATIONS

Korean Notice of Allowance in Korean Appln. No. 10-2014-0163255, dated Oct. 19, 2020, 28 pages (with English translation).

* cited by examiner

COOKING DEVICE AND VENTILATION APPARATUS

CROSS-REFERENCE TO RELATED APPLICATION

This application claims priority under 35 U.S.C. § 119 to Korean Patent Application No. 10-2014-0163255, filed in Korea on Nov. 21, 2014, whose entire disclosure is hereby incorporated by reference.

FIELD

This application is related to a cooking device and a ventilation apparatus.

BACKGROUND

Generally, a ventilation apparatus is used in factories in which a large amount of contaminants are generated, homes or restaurants. In particular, the ventilation apparatus is usefully used in a case in which a contamination source is partially generated on a floor surface which is distant from an exhaust port, a case in which it is difficult to install the exhaust port close to the contamination source due to other structures, or a case in which the contamination source is suddenly generated.

SUMMARY

An innovative aspect of the subject matter described in this specification may be implemented in a cooking device that includes a main body that includes a cooking space and that is configured to cook food; and a ventilation apparatus that is located at a lower side of the main body, that is configured to suck air into the main body, that is configured to discharge air from the main body, and that includes a base that is connected to the lower side of the main body and that includes an introduction port; a swirler that is configured to generate suction by rotating air around the introduction port of the base and that includes a plurality of wings; a driving unit that is configured to rotate the swirler; and a swirler guide that is configured to cover an underside of the swirler and that is configured to guide a flow of air around a center of the swirler.

These and other implementations can each optionally include one or more of the following features. The swirler is located under the introduction port. The driving unit is located above the introduction port. The swirler guide includes a first part that defines an opening through which air passes; and a second part that is configured to extend from the first part toward an outside of the ventilation apparatus and that is rounded downward toward the outside of the ventilation apparatus. At least a portion of the second part has an upwardly convex shape. An angle that is defined by one end of the second part and by a vertical line that passes through the one end of the second part is less than 90°. A first angle that is defined by one end of the second part and by a first vertical line that passes through the one end of the second part is different from a second angle that is defined by another end of the second part and by a second vertical line that passes through the other end of the second part.

A first distance from a center of the swirler guide to one end of the second part is different from a second distance from the center of the swirler guide to another end of the second part. A diameter of the opening is less than or equal to a diameter of a circle that is defined by inner ends of the plurality of wings. The swirler guide further includes a plurality of fixing parts that are located adjacent to the second part and that are configured to fix the swirler guide to the base. The plurality of fixing parts are configured such that one end of each fixing part is closer to a center of the swirler guide than an opposite end of each fixing part. The swirler guide is configured to cover an entirety of the plurality of wings. The cooking device further includes a filter unit that is connected to the swirler guide and that is configured to filter air before passing through the opening. The swirler is located in a recessed portion of the base.

Another innovative aspect of the subject matter described in this specification may be implemented in a ventilation apparatus that includes a base that includes an introduction port; a swirler that is configured to generate suction by rotating air around the introduction port of the base and that includes a plurality of wings; a driving unit that is configured to rotate the swirler; and a swirler guide that is configured to cover an underside of the swirler, that is rounded downward, and that is configured to guide a flow of air around a center of the swirler.

These and other implementations can each optionally include one or more of the following features. The driving unit is located above the base. The swirler is located under the base. The swirler guide includes a first part that defines an opening through which air passes; and a second part that is configured to extend from the first part toward an outside of the ventilation apparatus and that is rounded downward toward the outside of the ventilation apparatus. The second part is configured to cover the plurality of wings. An angle that is defined by one end of the second part and by a vertical line that passes through the one end of the second part is less than 90°. The swirler guide includes a plurality of fixing parts that are located adjacent to the second part and that are configured to fix the swirler guide to the base. The plurality of fixing parts are configured such that one end of each fixing part is closer to a center of the swirler guide than an opposite end of each fixing part.

The present disclosure is directed to providing a cooking device and a ventilation apparatus in which suction performance is able to be maintained regardless of an installation position thereof, and user safety is enhanced.

DETAILED DESCRIPTION

Figure 1:
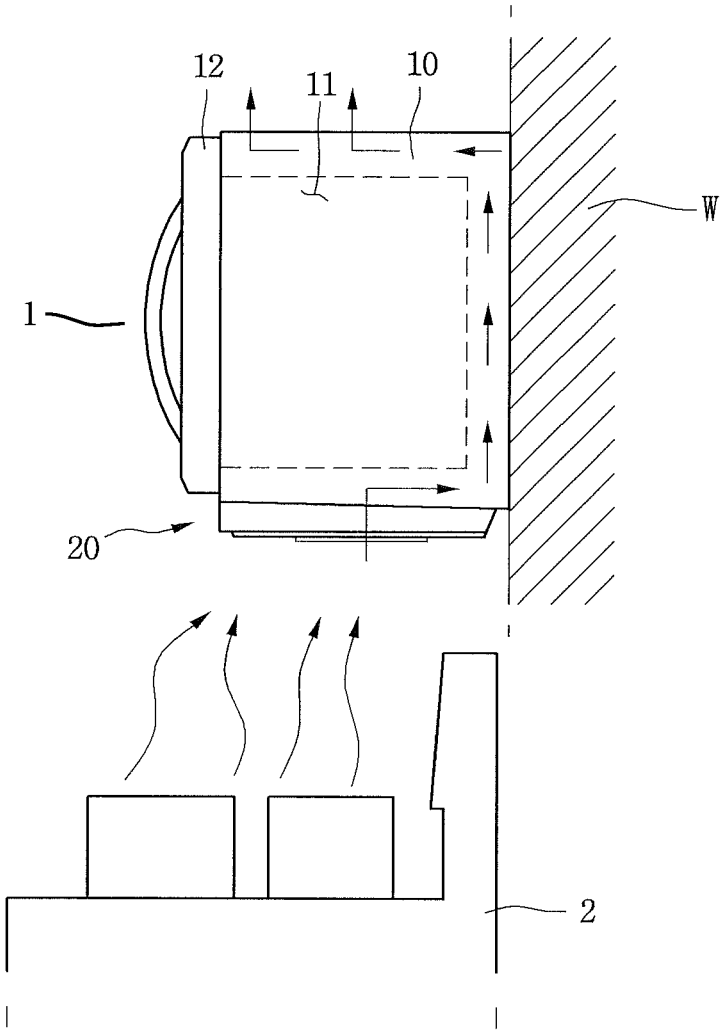
FIG. 1 is a view of an example cooking device.

FIG. 1 illustrates an example cooking device.

Referring to FIG. 1, the cooking device 1 may be installed at, for example, a wall W of a kitchen. In some implementations, the cooking device 1 may be a wall-mounted microwave oven. As long as the cooking device 1 can be installed at the wall W, a type of the cooking device 1 is not limited.

The cooking device 1 may include a main body 10 having a cooking space 11, and a door 12 which is connected with the main body 10 to open and close the cooking space 11.

Therefore, the cooking device 1 may perform cooking of food accommodated in the cooking space 11.

The cooking device 1 may further include a ventilation apparatus 20 which suctions external contaminated air and discharges the suctioned air to an outside of the cooking device 1.

The ventilation apparatus 20 may be disposed at a lower side of the main body 10. The main body 10 may have an exhaust port through which air flowing in the ventilation apparatus 20 is discharged. In some implementations, the contaminated air suctioned by the ventilation apparatus 20 may flow through an exhaust path in the main body 10, and then may be discharged through the exhaust port. Alternatively, in a state in which the ventilation apparatus 20 is installed at the main body 10, the ventilation apparatus 20 may be disposed so that the exhaust port thereof is in communication with an exhaust hole formed at the wall.

The ventilation apparatus 20 may be operated separately from a cooking operation in the main body 10.

In some implementations, only the cooking operation may be performed in the cooking device 1, only a ventilating operation may be performed in the cooking device 1 by the ventilation apparatus 20, or the cooking and ventilating operations may be simultaneously performed.

For example, the cooking device 1 may be located above another cooking device 2. The ventilation apparatus 20 may suction the contaminated air generated while the food is cooked in the other cooking device 2.

Hereinafter, the ventilation apparatus 20 will be described in detail.

Figure 2:
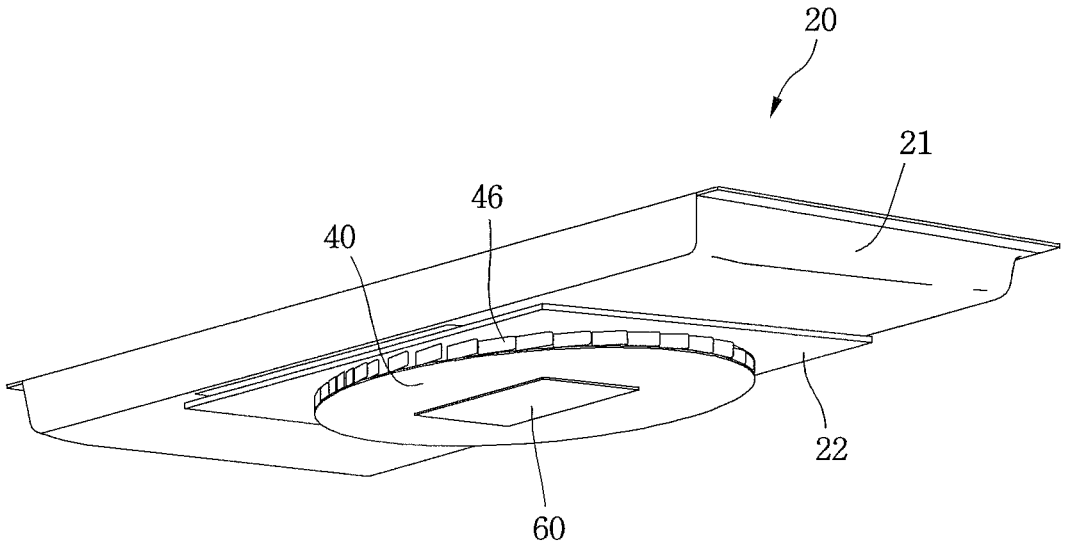
FIG. 2 is an underside view of an example ventilation apparatus.
Figure 3:
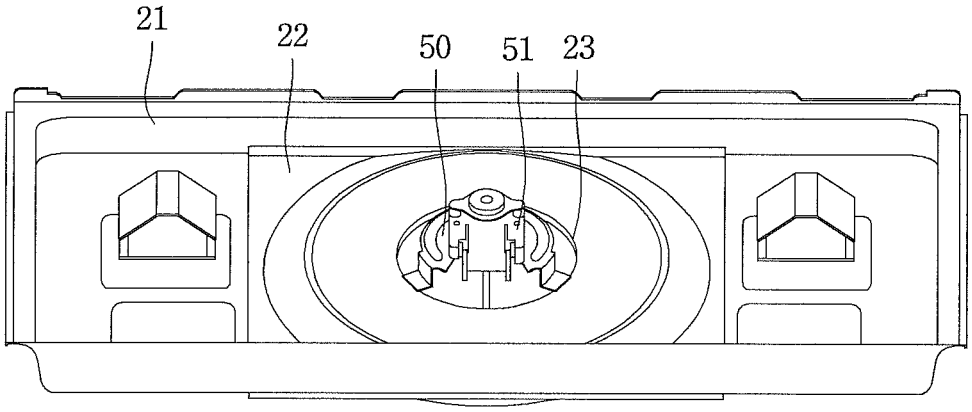
FIG. 3 is a top view of an example ventilation apparatus.
Figure 4:
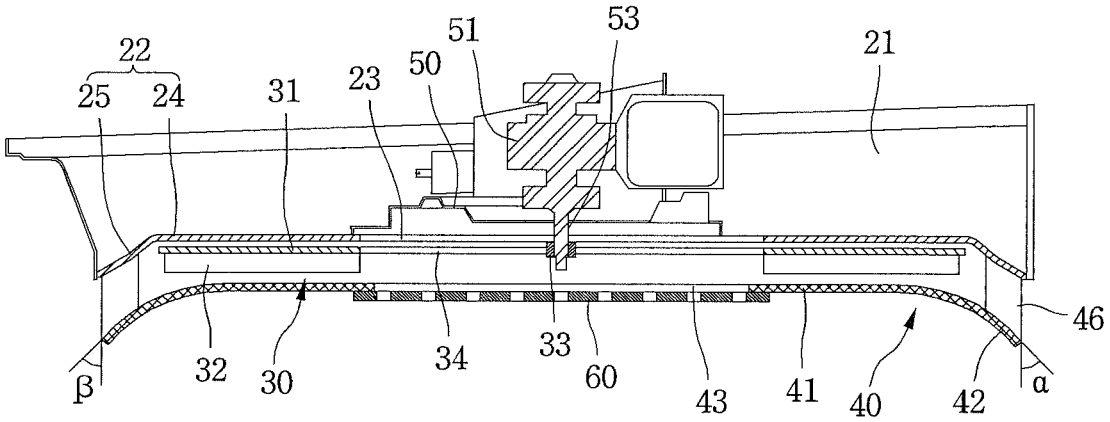
FIG. 4 is a vertical cross-sectional view of an example ventilation apparatus.

FIGS. 2 to 4 illustrate example ventilation apparatuses.

Referring to FIGS. 2 to 4, the ventilation apparatus may include bases 21 and 22 which provide a path of the contaminated air.

The bases 21 and 22 may be coupled to the lower side of the main body 10. The bases 21 and 22 may include a first base 21 and a second base 22. The second base 22 may be fastened to the first base 21 by a fastening member. Alternatively, the first base 21 and the second base 22 may be integrally formed with each other.

An introduction port 23 through which air is introduced may be provided at the second base 22.

The ventilation apparatus 20 may further include a driving unit 51, and a swirler 30 which receives power from the driving unit 51 to be rotated.

The driving unit 51 may be installed at an installation part 50, and the installation part 50 may be installed at the second base 22. At this time, the driving unit 51 installed at the installation part 50 may be disposed to be spaced upward from the introduction port 23 of the second base 22.

The reason why the driving unit 51 is spaced upward from the introduction port 23 of the second base 22 is to minimize that the driving unit 51 serves as a flow resistance element of the suctioned contaminated air. The contaminated air passed through the introduction port 23 may be in contact with the driving unit 51. In some implementations, the driving unit 51 may be cooled.

For example, the driving unit 51 may be a motor, and a shaft 53 of the motor may pass through the introduction port 23.

The driving unit 51 may be located at one side of the second base 22, and the swirler 30 may be located at the other side of the second base 22. The driving unit 51 may be located above the second base 22, and the swirler 30 may be located under the second base 22.

The second base 22 may include a recessed portion 24 serving as a space in which the swirler 30 is located. Due to the recessed portion 24, an outer portion 25 of the second base 22 may serve as a flow guide of air which flows by the swirler 30. For example, the outer portion 25 of the second base 22 may be formed to be gradually rounded downward toward an outside.

The swirler 30 may include a rotary plate 31 which is rotated, and a plurality of wings 32 which are disposed along an edge of the rotary plate 31 in a circumferential direction thereof.

A hole 34 through which the contaminated air passes may be formed at the rotary plate 31.

The rotary plate 31 may include a connection part 33 for connection with the shaft 53 of the motor. The connection part 33 may be located at a center of the rotary plate 31.

For a smooth flow of the contaminated air, the hole 34 may be disposed to be vertically overlapped with the introduction port 23 of the second base 22.

The plurality of wings 32 may be disposed on a lower surface of the rotary plate 31 to be spaced from each other in the circumferential direction of the rotary plate 31.

The ventilation apparatus 20 may further include a swirler guide 40 which covers a lower side of the swirler 30 and guides the flow of the air to form a swirl.

The swirler guide 40 may include an opening 43 through which the contaminated air passes.

The swirler guide 40 may cover at least a part of each of the plurality of wings 32 of the swirler 30 at a lower side of the swirler 30. To ensure user safety, the swirler guide 40 may cover the whole of the plurality of wings 32.

A diameter of the opening 43 of the swirler guide 40 may be the same as or smaller than a diameter of an imaginary circle which connects inner ends of the plurality of wings 32. Also, an outer diameter of the swirler guide 40 may be greater than a diameter of an outer end of the swirler 30 (or an imaginary circle which connects outer ends of the plurality of wings 32).

Therefore, the wings 32 of the swirler 30 may be prevented from being exposed to an outside by the swirler guide 40, and thus the user safety may be enhanced.

Further, when the ventilation apparatus 20 is located above the other cooking device 2, a user's hand which handles the cooking device 1 or the other cooking device 2 may be prevented from being in contact with the swirler 30, and thus the user safety may be ensured.

The swirler guide 40 may include a first part 41 at which the opening 43 is provided, and a second part 42 which extends from the first part 41 toward an outside. An outer end of the second part 42 may be located lower than the opening 43. The second part 42 may cover a part or the whole of each of the plurality of wings 32. Alternatively, the first part 41 may cover the whole of the plurality of wings 32.

For example, the second part 42 may extend from the first part 41 so as to be gradually rounded downward toward the outside. At this time, a part or the whole of the second part 42 may be rounded downward in an upwardly convex shape.

The reason why the second part 42 is formed to be rounded downward is to allow the air flowing by the swirler 30 to smoothly flow downward due to a Coanda effect.

When the air flowing by the swirler 30 smoothly flows downward, the swirl may be easily formed, and thus suction performance of the ventilation apparatus 20 may be enhanced. Also, when the air flowing by the swirler 30 smoothly flows downward, an area in which the swirl is formed is increased, and thus the suction performance of the ventilation apparatus 20 may be enhanced.

A first angle $\alpha$ between one end (e.g., a right end of FIG. 4) of the second part 42 and a vertical line which is formed at the one end of the second part 42 may be the same as or different from a second angle β between the other end (e.g., a left end of FIG. 4) of the second part 42 and a vertical line which is formed at the other end of the second part 42.

For example, in some implementations in which an obstacle is located close to the one end of the second part 42, when the first angle α is great, the air flowing due to the second part 42 may collide with the obstacle, and thus the swirl may not be smoothly formed. In some implementations, the first angle α may be reduced.

In some implementations, since the angle of the one end of the second part 42 is formed to be different from the angle of the other end thereof, the swirl may be effectively formed, even when the obstacle or the wall is located close to the ventilation apparatus 20. When the obstacle or the wall is not located close to the ventilation apparatus 20, the angle between the end of the second part 42 and the vertical line may be formed constantly in the circumferential direction.

However, to generate the Coanda effect by the second part 42, the angle between the second part 42 and the vertical line may be greater than 0° and smaller than 90°.

A distance from a center of the swirler guide 40 to a first end of the second part 42 may be the same as or different from a distance from the center of the swirler guide 40 to a second end of the second part 42. In some implementations, when the swirler guide 40 is projected on a plane, the swirler guide 40 may have a circular shape or a non-circular shape. At this time, the center of the swirler guide 40 may be the same as or different from a rotational center of the swirler 30.

For example, the first part 41 may be formed in a circular plate shape, and a length of the second part 42 may be differently formed in the circumferential direction.

In some implementations, a size of the swirl formed at the swirler guide 40 may be different.

As another example, a slidable third part may be connected to the second part 42. In some implementations, while the third part is slid, the size of the swirl and an angle between the third part and the vertical line may be adjusted.

As still another example, a plurality of second parts 42 may be slidably connected to the first part 41. In some implementations, the size of the swirl and an angle between an end of the second part 42 and the vertical line may be adjusted by sliding a part or the whole of the plurality of second parts 42 with respect to the first part 41.

In some implementations, as the Coanda effect is generated at the whole of the plurality of second parts, two adjacent second parts 42 in a state in which the plurality of second parts 42 are maximally slid to an outside of the swirler guide 40 may be vertically overlapped with each other. Then, the plurality of second parts 42 may be disposed at different heights.

The swirler guide 40 may further include a plurality of fixing parts 46 which fix the swirler guide 40 to the second base 22.

The plurality of fixing parts 46 may be provided at an upper side of the swirler guide 40, and then may be fixed to the second base 22. At this time, to prevent an interference between the plurality of fixing parts 46 and the swirler 30, the plurality of fixing parts 46 may be provided at the second part 42.

A diameter of an imaginary circle which connects inner ends of the plurality of fixing parts 46 may be greater than a diameter of an imaginary circle which connects outer ends of the plurality of wings 32 of the swirler 30.

For example, the plurality of fixing parts 46 may be fixed to the second base 22 by a screw, an adhesive, a welding method or a hooking method. A method of fixing the plurality of fixing parts 46 to the second base 22 is not limited.

The plurality of fixing parts 46 may be disposed to be spaced in the circumferential direction of the swirler guide 40. At this time, the plurality of fixing parts 46 may be disposed so that an extension line of each thereof does not pass through the shaft 53 of the motor, the rotational center of the swirler 30 or a center line of the swirler guide 40, e.g., is deviated therefrom.

The plurality of fixing parts 46 may be formed to extend linearly or to be rounded.

Therefore, due to an arrangement of the plurality of fixing parts 46, the air flowing by the swirler 30 may flow to have an orientation.

Also, since the plurality of fixing parts 46 cover a part of a gap between the second base 22 and the swirler guide 40, the user's hand is prevented from being inserted between the second base 22 and the swirler guide 40 by the plurality of fixing parts 46, and thus the user safety may be ensured.

The ventilation apparatus 20 may further include a filter unit 60 which filters the contaminated air before the contaminated air passes through the opening 43 of the swirler guide 40. The filter unit 60 may cover the opening 43 of the swirler guide 40, and may be coupled to the swirler guide 40.

Hereinafter, an operation of the ventilation apparatus 20 will be described.

Figure 5:
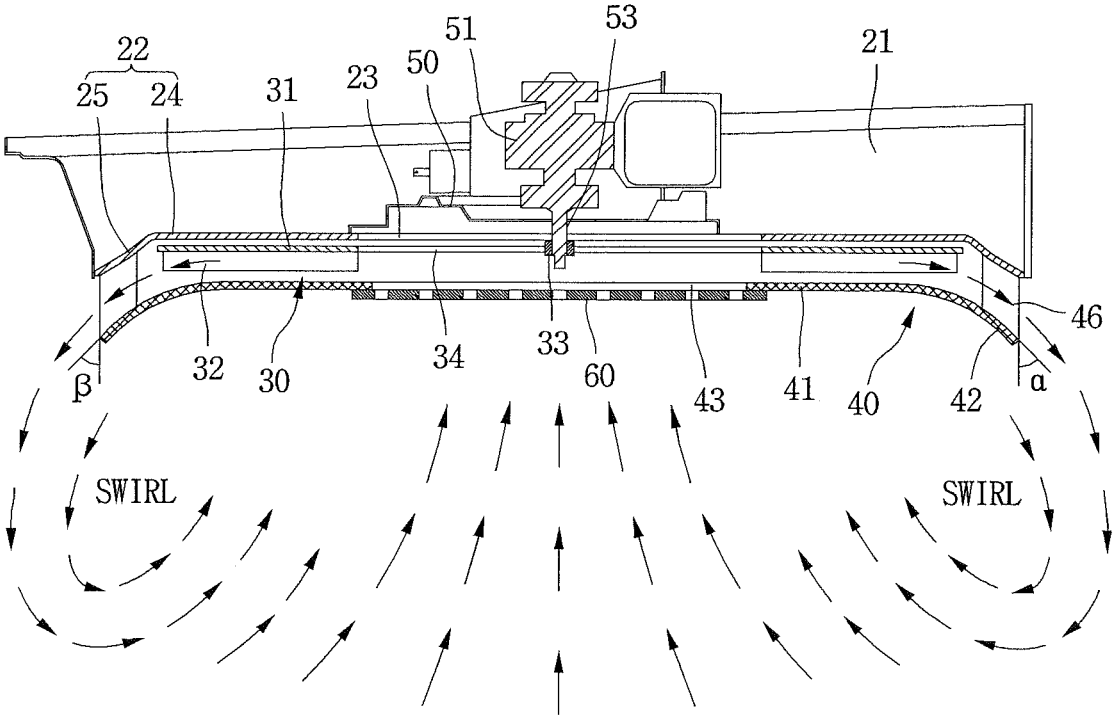
FIG. 5 is a view illustrating a flow of air generated during operation of an example ventilation apparatus.

FIG. 5 illustrates a flow of air generated during operation of an example ventilation apparatus.

Referring to FIG. 5, when an operation command of the ventilation apparatus 20 is input, the driving unit 51 is turned on. When the driving unit 51 is turned on, the swirler 30 is rotated in one direction.

When the swirler 30 is rotated in one direction, the wings 32 push outward the contaminated air flowing to the hole 34 of the rotary plate 31 in a radial direction of the rotary plate 31. And when the air passes through the introduction port 23 of the second base 22, not only the contaminated air passing through the introduction port 23 but also air therearound are intended to pass through the introduction port 23 of second base 22. Due to such a flow of the air, the swirl is formed under the rotary plate 31.

In some implementations, since the swirler guide 40 which guides downward the air flowing in the radial direction of the swirler 30 is provided under the swirler 30, the swirl may be effectively formed by the swirler guide 40.

In some implementations, a portion of the contaminated air passes through the introduction port 23 of the second base 22, and another portion thereof flows along the swirler guide 40.

What is claimed is:

1. A cooking device comprising:

a main body that includes a cooking space and that is configured to cook food; and a ventilation apparatus that is located at a lower side of the main body, that is configured to suck air into the main body, and that comprises:

a base that is connected to the lower side of the main body, that includes a first base and a second base, and that defines an introduction port;

a swirler that is configured to generate suction by rotating air around the introduction port of the base, that is located under the introduction port, and that includes a plurality of wings;

a driving unit that is configured to rotate the swirler, that is located above the introduction port, and that includes a shaft that is connected to the swirler; and a swirler guide that is configured to cover an underside of the swirler, that is configured to guide a flow of air around a center of the swirler, and that comprises:

a first part that defines an opening that overlaps the introduction port in a vertical direction and through which air sucked into the main body passes; and a second part that is configured to extend from the first part toward an outside of the ventilation apparatus and that is rounded downward toward the outside of the ventilation apparatus, wherein an outer end of the second part is located lower than the opening, wherein the shaft passes through the introduction port, wherein the second base includes a recessed portion that defines a space in which the swirler is located and an outer portion that is configured to guide air that flows by the swirler, wherein, based on swirler rotating, the ventilation apparatus is configured to move air through the opening of the swirler guide, and wherein a portion of the air moved through the opening of the swirler guide moves through the introduction port and a remaining portion of the air, flowing in the radial direction of the swirler, moves between the outer portion of the second base and the swirler guide, and is discharged from the ventilation apparatus to form a swirl.

2. The cooking device according to claim 1, wherein at least a portion of the second part has an upwardly convex shape.

3. The cooking device according to claim 1, wherein an angle that is defined by one end of the second part and by a vertical line that passes through the one end of the second part is less than 90°.

4. The cooking device according to claim 1, wherein a first angle that is defined by one end of the second part and by a first vertical line that passes through the one end of the second part is different from a second angle that is defined by another end of the second part and by a second vertical line that passes through the other end of the second part.

5. The cooking device according to claim 1, wherein a first distance from a center of the swirler guide to one end of the second part is different from a second distance from the center of the swirler guide to another end of the second part.

6. The cooking device according to claim 1, wherein a diameter of the opening is less than or equal to a diameter of a circle that is defined by inner ends of the plurality of wings.

7. The cooking device according to claim 1, wherein the swirler guide further comprises a plurality of fixing parts that are located adjacent to the second part and that are configured to fix the swirler guide to the base.

8. The cooking device according to claim 1, wherein the swirler guide is configured to cover an entirety of the plurality of wings.

9. The cooking device according to claim 1, further comprising a filter unit that is connected to the swirler guide and that is configured to filter air before passing through the opening.

* * * * *